US006670588B2

(12) United States Patent
Kitano et al.

(10) Patent No.: US 6,670,588 B2
(45) Date of Patent: Dec. 30, 2003

(54) INDUCTIVE HEATING ROLLER APPARATUS

(75) Inventors: Yoshio Kitano, Kyoto (JP); Kozo Okamoto, Kyoto (JP); Yukio Horie, deceased, late of Kyoto (JP), by Yoko Horie, legal representative

(73) Assignee: Tokuden Co., Ltd., Kyoto (JP)

( * ) Notice: Subject to any disclaimer, the term of this patent is extended or adjusted under 35 U.S.C. 154(b) by 264 days.

(21) Appl. No.: 09/731,063

(22) Filed: Dec. 7, 2000

(65) Prior Publication Data

US 2003/0042251 A1 Mar. 6, 2003

(51) Int. Cl.[7] ..... H05B 6/14
(52) U.S. Cl. ..... 219/619; 219/661
(58) Field of Search ..... 219/619, 661, 219/647, 652, 662, 670, 669, 674, 676, 672, 216, 469; 399/330, 321, 328, 67; 363/98, 132

(56) References Cited

U.S. PATENT DOCUMENTS 4,755,648 A * 7/1988 Sawa ..... 219/661
5,272,719 A * 12/1993 Cartlidge et al. ..... 219/662
5,553,729 A * 9/1996 Kitano et al. ..... 219/619
5,752,150 A * 5/1998 Kato et al. ..... 399/330
5,895,598 A * 4/1999 Kitano et al. ..... 219/619
6,011,708 A * 1/2000 Doht et al. ..... 363/98
6,148,019 A * 11/2000 Fishman et al. ..... 373/147
6,405,000 B1 * 6/2002 Nakaya ..... 399/67

FOREIGN PATENT DOCUMENTS

| | | |
|---|---|---|
| JP | 07-150437 | 6/1995 |
| JP | 2532986 | 1/1997 |
| JP | 09-161963 | 6/1997 |

* cited by examiner

*Primary Examiner*—Quang T. Van
(74) *Attorney, Agent, or Firm*—Morgan, Lewis & Bockius LLP

(57) ABSTRACT

An inverter in which the three-phase power source is used as an input power source and the single phase voltage is outputted, is provided. The single phase output voltage of the inverter is applied onto the inductive coil of the inductive heat generation mechanism provided inside the rotating roller as the exciting voltage. Because the single phase voltage obtained by being phase-converted by the inverter is used, the unbalance is not generated among the phases of the three-phase power source which is the input power source.

9 Claims, 8 Drawing Sheets

INDUCTIVE HEATING ROLLER APPARATUS

BACKGROUND OF THE INVENTION

1. Field of the Invention

The present invention relates to an inductive heating roller apparatus.

2. Description of the Related Art

As commonly known, the inductive heating roller apparatus is structured by arranging an inductive heat generation mechanism provided with an inductive coil inside a rotating roller. In such the structure, when the inductive coil is excited by the AC power source, the magnetic flux is generated along the shaft center direction of the roller, and the magnetic flux passes through a closed magnetic path one portion of which is formed of the peripheral wall of the roller, and by this magnetic flux, the current is induced in the roller, and the peripheral wall of the roller is heat-generated by the Joule heat due to this current.

As being understood by this description, because the closed magnetic path for the generated magnetic flux is a single closed magnetic path including the peripheral wall of the roller, the AC power source to excite the inductive coil is limited to a single phase power source. On the one hand, in general factories, because three-phase power source is a main power source, it is required that the inductive coil is excited by the three-phase power source.

However, in order to obtain the single phase voltage from the three-phase power source, when two lines of the three-phase lines are used, and the single phase voltage is obtained from between the two lines, and this voltage is applied onto each inductive coil, the unbalance of the power source is generated between the case of two lines between which the inductive coil is connected, and the case of two lines between which the inductive coil is not connected. Accordingly, the utilization efficiency of the power source is lowered.

SUMMARY OF THE INVENTION

The object of the present invention is to apply the single phase voltage onto the roller without generating any unbalance in the three-phase power source, when the three-phase power source is used as the power source for the roller heat generation.

In the structure of the present invention, an inductive heat generation mechanism having an inductive coil is arranged inside a rotating roller, an inverter having a three-phase power source as an input power source, and outputting the single phase voltage by the phase conversion is prepared, and the single phase output voltage from the inverter is applied onto the inductive coil as the exciting voltage.

As an inverter, an inverter using, for example, a SCR, or a transistor can be appropriately used. Also in any one of inverters, in order to obtain the single phase voltage from the three-phase voltage, the three-phase voltage is converted once into the DC voltage, and the DC voltage is converted again and the single phase voltage is obtained. In such the manner, when the single phase voltage obtained from the three-phase voltage is used for the excitation of the inductive coil, no unbalance is generated in the three-phase power source which is the input power source.

When a plurality of inductive coils constituting the inductive heat generation mechanism are provided, the single phase voltage obtained from the inverter may also be applied on each of inductive coils as the exciting voltage. In this case, when the single phase voltage applied onto each of inductive coils is the same phase to each other, the closed magnetic path for the magnetic flux induced by each of inductive coils, is independent of each other, and the interference does not occur with each other.

A value of the single phase output voltage of the inverter can be adjusted by changing an arc angle of SCR constituting the inverter. Accordingly, in the case where a plurality of inverters are prepared, and respective single phase output voltage are applied onto respective inductive coils, when each of inverters is independently adjusted, an amount of the magnetic flux induced by each of inductive coils can be adjusted, and accordingly, the peripheral wall temperature of the roller can be freely changed along the length direction of the roller.

DETAILED DESCRIPTION OF THE PREFERED EMBODIMENT

Figure 1:
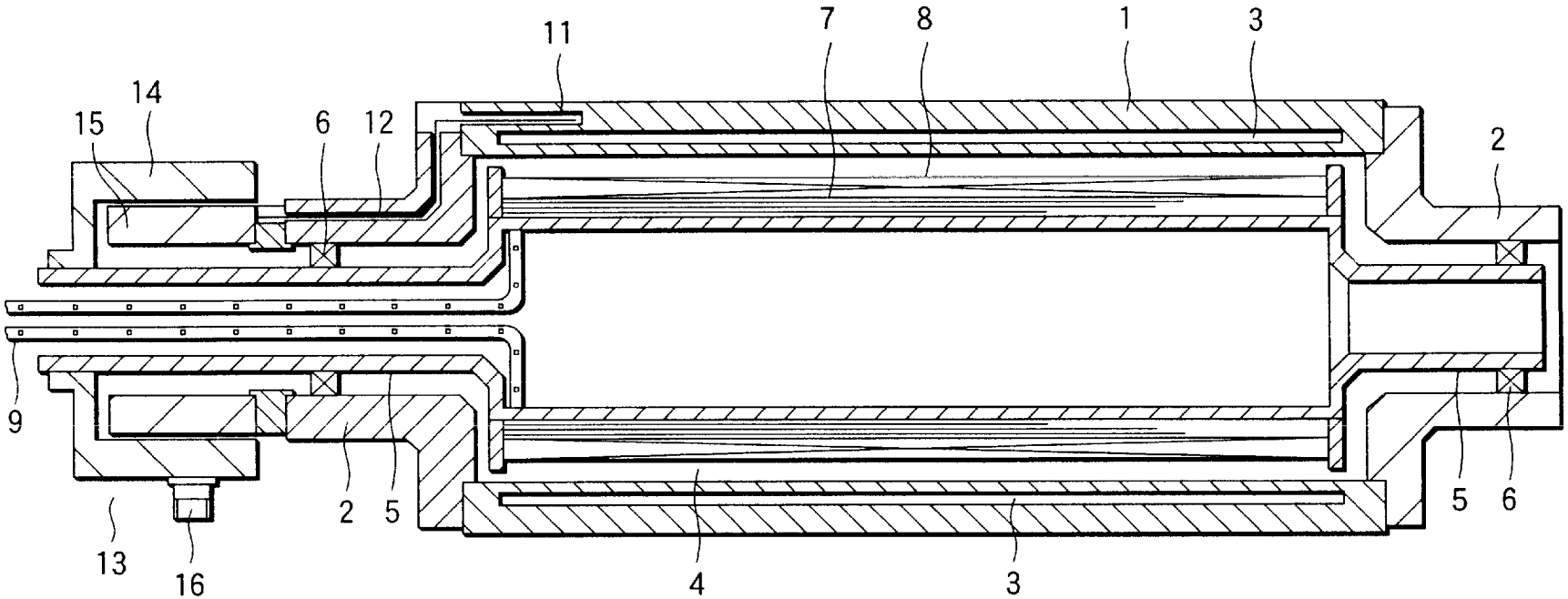
FIG. 1 is a sectional view showing a first embodiment of the present invention.

Referring to the drawings, an embodiment of the present invention will be described below. In FIG. 1, numeral 1 is a roller main body, numeral 2 are journals integrally provided on its both sides, and are rotatably supported through bearings, not shown, on the base. Numeral 3 is jacket chambers provided inside the peripheral wall of the roller 1, and a plurality of the jacket chambers are formed by drilling by, for example, a drill, and end portions of each of the jacket chambers 3 are communicated to each other. Inside each of jacket chambers 3, a heating medium of two phase of gas-liquid is filled.

Numeral 4 is an inductive heat generation mechanism and supported by a supporting rode 5. The supporting rod 5 is inserted into the journal 2, and supported by the journal 2 through a bearing 6. The inductive heat generation mechanism 4 is structured by an iron core 7 and an inductive coil 8 wound around the iron core 7. A power source lead wire 9 connected to the inductive coil 8 passes through the inside of a supporting rod 5, and is led out to the outside from its end portion of the supporting rod 5.

Numeral 11 is a temperature sensor inserted into the peripheral wall of the roller main body 1, and is used for detecting the temperature of the peripheral wall of the roller main body 1, and outputs a voltage signal corresponding to the temperature. This voltage signal is sent to a temperature signal transmission mechanism 13 through a signal lead wire 12. Specifically, the temperature signal transmission mechanism 13 structured by a rotation transformer composed of a pair of coils which are magnetically connected, is used.

In the drawing, a stator 14 provided with a stator side coil is supported by the supporting rod 5, and a rotor 15 provided with a rotator side coil is supported by the journal 2. A signal lead wire 12 is connected to the rotor side coil. The voltage corresponding to the temperature of the peripheral wall of the roller main body 1 is sent to the rotor side coil through the signal lead wire 12. Then, the voltage is transmitted to the stator side coil connected to this coil. By measuring this voltage, the temperature of the peripheral wall of the roller main body 1 is obtained. This measured value is taken out from an output terminal 16 to the outside.

Figure 2:
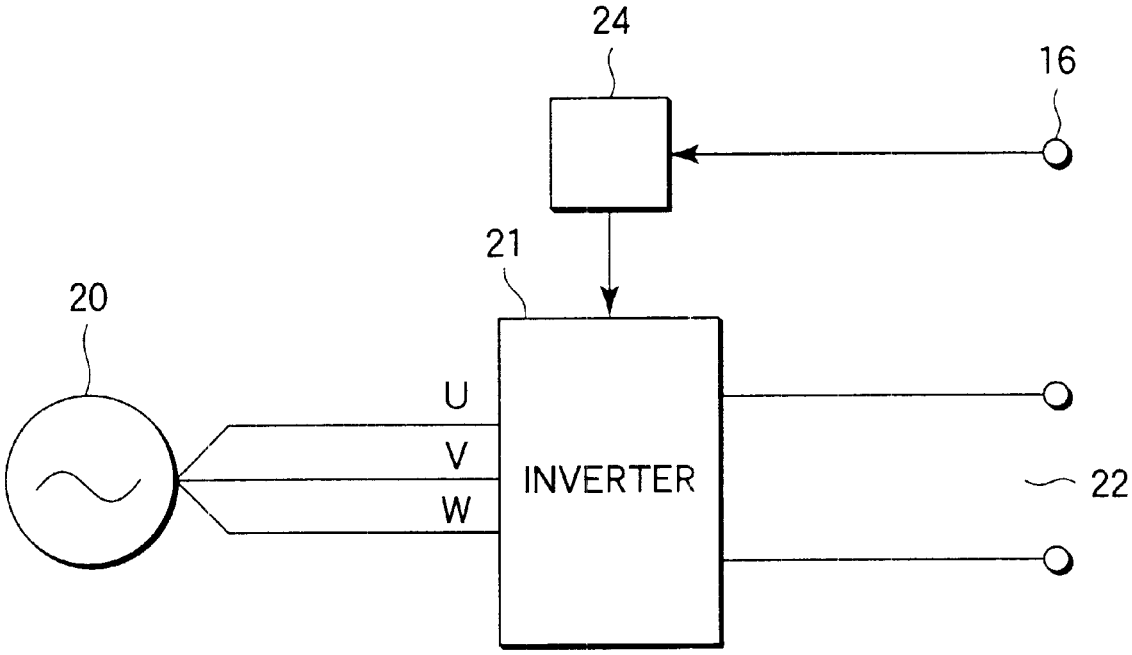
FIG. 2 is a circuit diagram for an inductive heat generation mechanism shown in FIG. 1.

According to the present invention, three phase power source is used as the power source. In FIG. 2, numeral 20 is the three phase power source, and numeral 21 is an inverter whose input power source is the three phase power source and which outputs the single phase AC voltage. The inverter 21 is mainly structured by a rectifying apparatus to rectify the three phase voltage, and an SCR circuit or a transistor circuit to convert the DC voltage from the rectifying apparatus into the single phase AC voltage. In the structure of the present invention, an arbitrarily structured one of this kind of inverters may be appropriately used.

Numeral 22 is an output circuit of the inverter 16, and the single phase voltage is outputted from this circuit. The single phase voltage outputted from this output circuit 22 is applied onto the inductive coil 8 through the power source lead wire 9 and excites it. A voltage signal from the signal lead wire 12, that is, the voltage signal obtained from the stator side coil of the temperature signal transmission mechanism 13 is supplied from an output terminal 16 to a temperature adjuster 24. The voltage signal is compared here to a set temperature value of the roller main body 1, and a signal corresponding to the difference is sent to the inverter 20. In the inverter 20, according to the signal, the arc angle of the SCR is adjusted, and the single phase output voltage value is adjusted. Thereby, the surface temperature of the roller main body 1 is adjusted to the setting value.

In the above structure, the voltage obtained from the three phase power source 20 is inputted into the inverter 21, and the single phase voltage obtained from it, is applied onto the inductive coil 8 in the rotating roller main body 1 from the output circuit 22. Thereby, the magnetic flux is generated and the current is induced in the peripheral wall portion of the roller main body 1, and by this current, the roller main body 1 is heat-generated. In this case, because the inverter 21 rectifies the three-phase voltage and converts it into the single phase voltage, even when the inverter 21 outputs the single phase voltage, no unbalance is generated on the three-phase power source 20 side.

Figure 3:
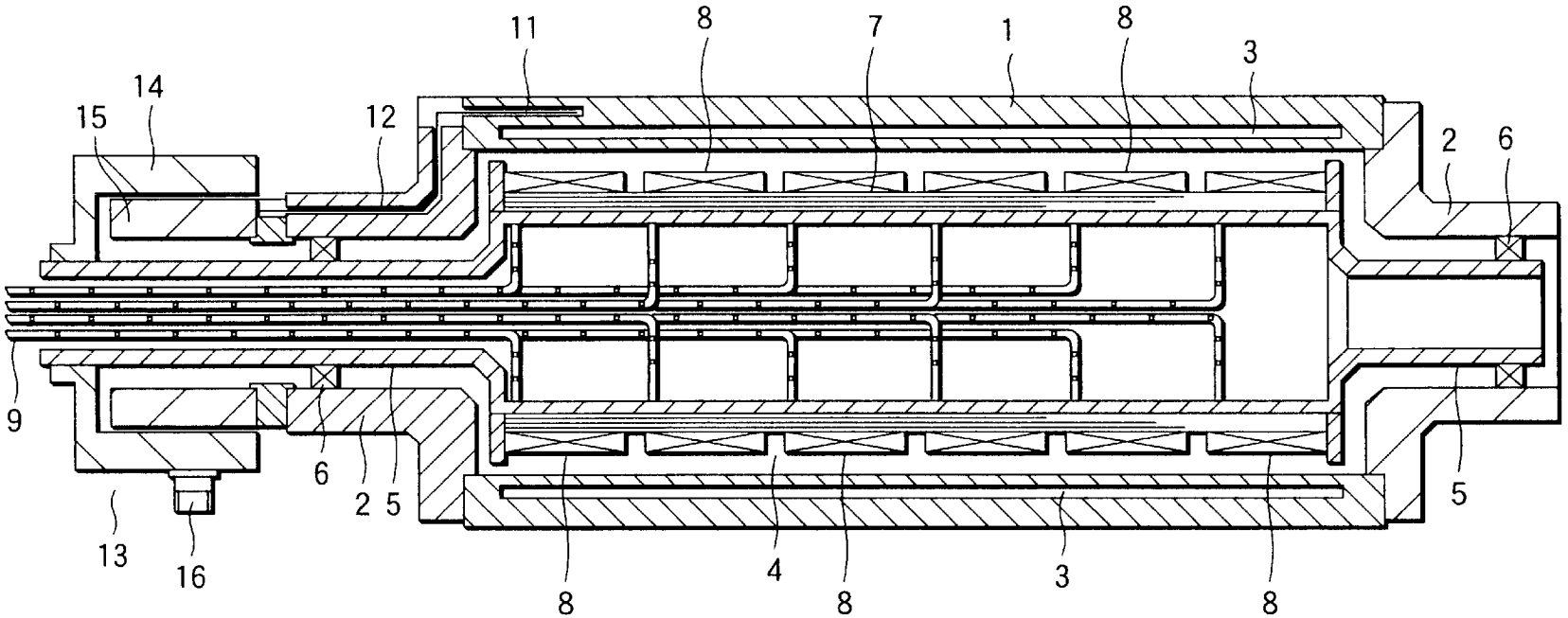
FIG. 3 is a sectional view showing a second embodiment of the present invention.

In second embodiment of the present invention shown in FIG. 3, as the inductive heat generation mechanism 4, the following one is shown, which is structured such that, around a long-sized cylindrical iron core which is structured by cylindrically laminating the long-sized steel plate bent so as to be along the involution curve, (refer to Japanese Utility Model Registration No. 2532986), a plurality of (6 in the example in the drawing) inductive coils 8 which commonly uses this iron core 7, are wound in parallel. The power source lead wire 9 is respectively connected to each of inductive coils 8.

Further, the inverter 21 has a plurality of output circuits 22, and the single phase and same phase AC voltage is outputted from each output circuit 22. This output voltage is applied onto each inductive coil 8 through the power source lead wire 9, and excites the coil 8. The other structure is not specifically different from that of FIG. 1.

In the case where generally the long-sized iron core is commonly used and the inductive heat generation mechanism is structured by winding 3 or its multiple inductive coils around the iron core in parallel, when each of inductive coils is excited by the three-phase power source, the magnetic flux induced by it crosses also the other inductive coils through the commonly used iron core. Thereby, the magnetic flux induced in each of inductive coils interferes with each other.

When in this manner, the magnetic flux induced by each of inductive coils interferes with each other, even when V phase in U. V, W phases of the three-phase circuit is made to opposite phase, and the voltage whose phase is shifted by 60° each is applied onto each of inductive coils, and the phase difference of the voltage applied onto each of inductive coils is reduced, the current induced in each of inductive coils is influenced on each other. Specifically, there is a tendency that the phase of the current induced in the inductive coil connected to the U phase is more delayed compared to the current induced in the other inductive coils connected to V phase and W phase, and the power factor is lowered. Accordingly, the unbalance is generated onto the load between phases. Of course, the power source unbalance among three-phase lines is also generated, and the utilization efficiency of the power source is also lowered.

Figure 4:
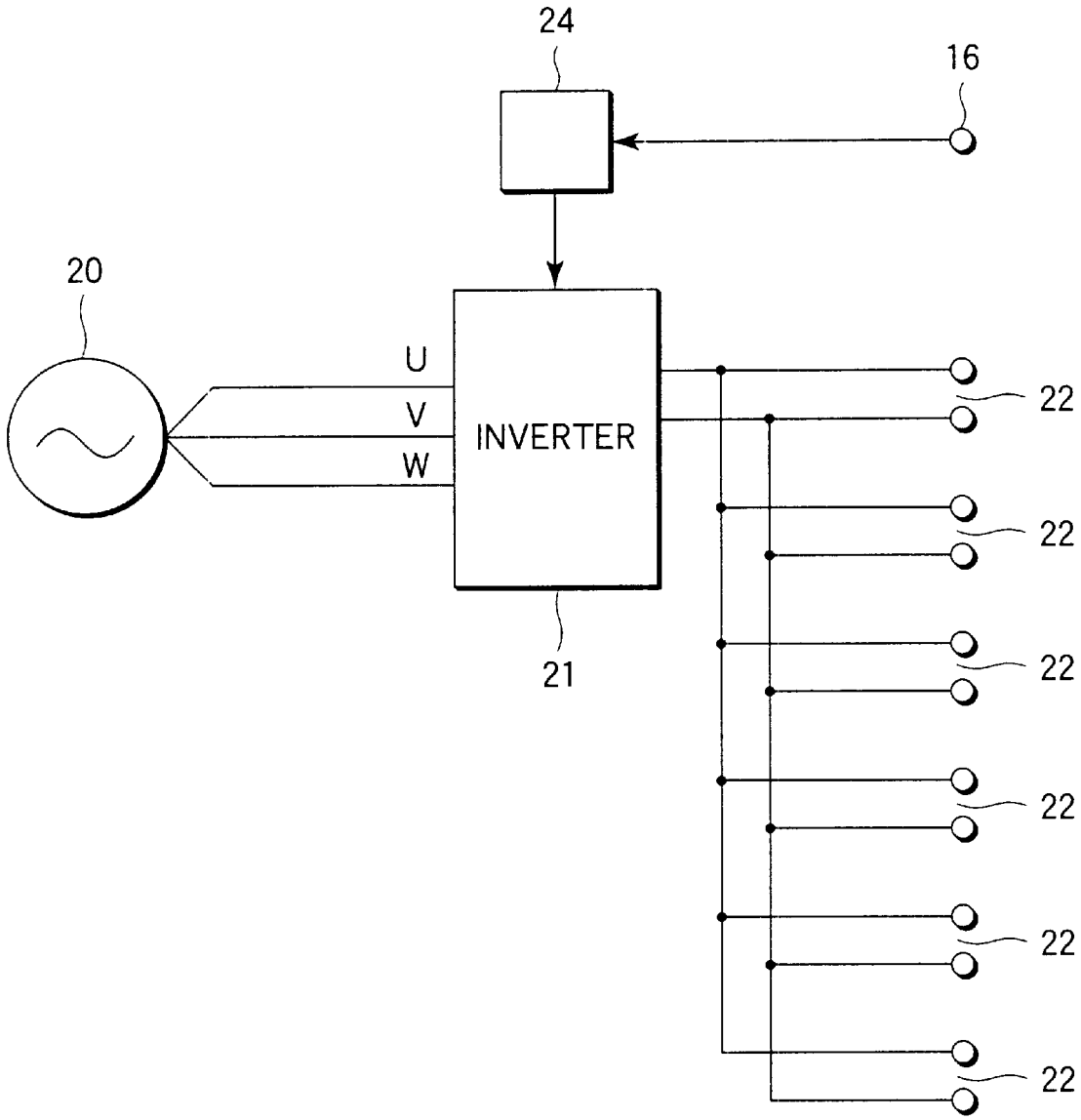
FIG. 4 is a circuit diagram for the inductive heat generation mechanism shown in FIG. 3.

However, as shown in FIG. 3 and FIG. 4, when the same and single phase voltage from the inverter 21 is applied onto each of inductive coils 8 and excites that, even when the iron core is commonly used, because there is no phase difference in the power source to excite each of inductive coils, there is no variation of the power factor by the relative interference with each other. Thereby, there is no generation of the unbalance on the three-phase power source side and the unbalance on the load side.

The structure shown in FIG. 3 shows a case in which one temperature sensor 11 is arranged, and the exciting voltage of each of inductive coils 8 is simultaneously controlled in the same manner. According to this, there is an advantage that the surface temperature of the roller main body 1 is uniformly controlled over its whole surface. However, there is a case where the surface temperature in each portion of the roller main body 1 is required to be controlled quickly responding to its change, or a case where the surface temperature in each portion along the shaft center direction of the roller main body 1 is required to be controlled to a partially different value, depending on the purpose of use of the roller main body 1.

Figure 5:
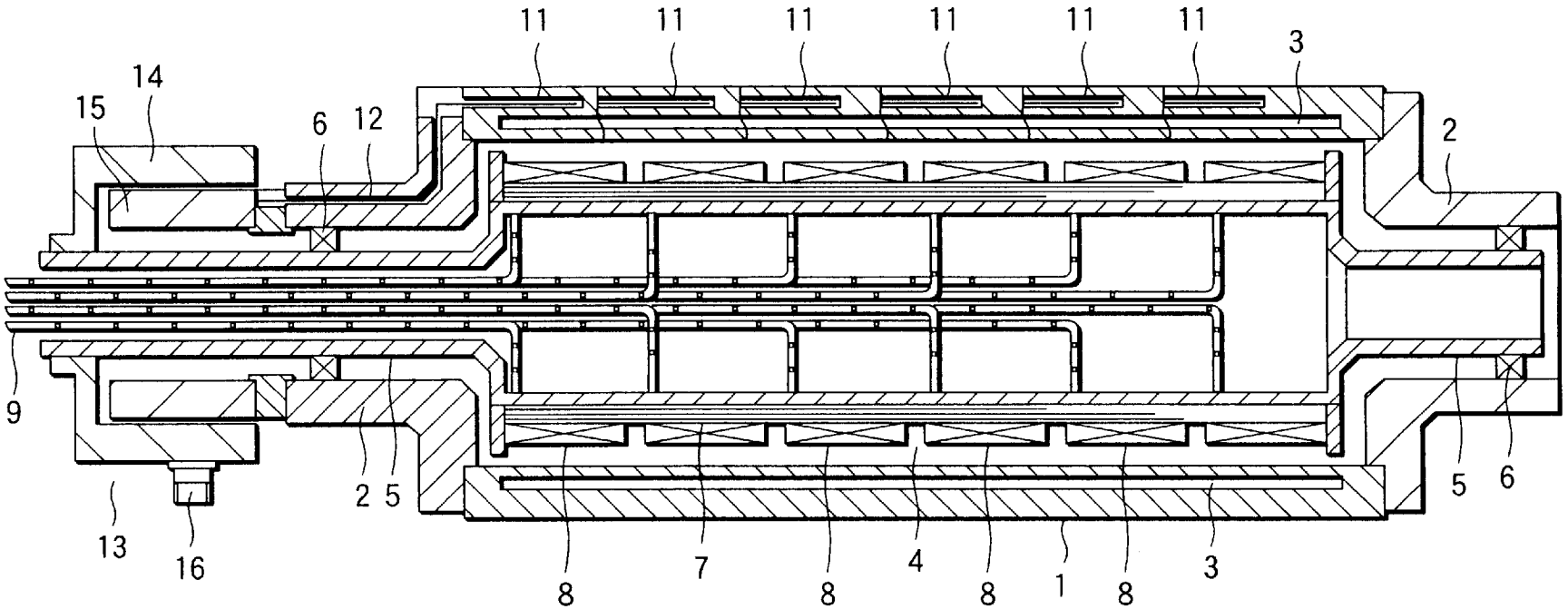
FIG. 5 is a sectional view showing still a third embodiment of the present invention.
Figure 6:
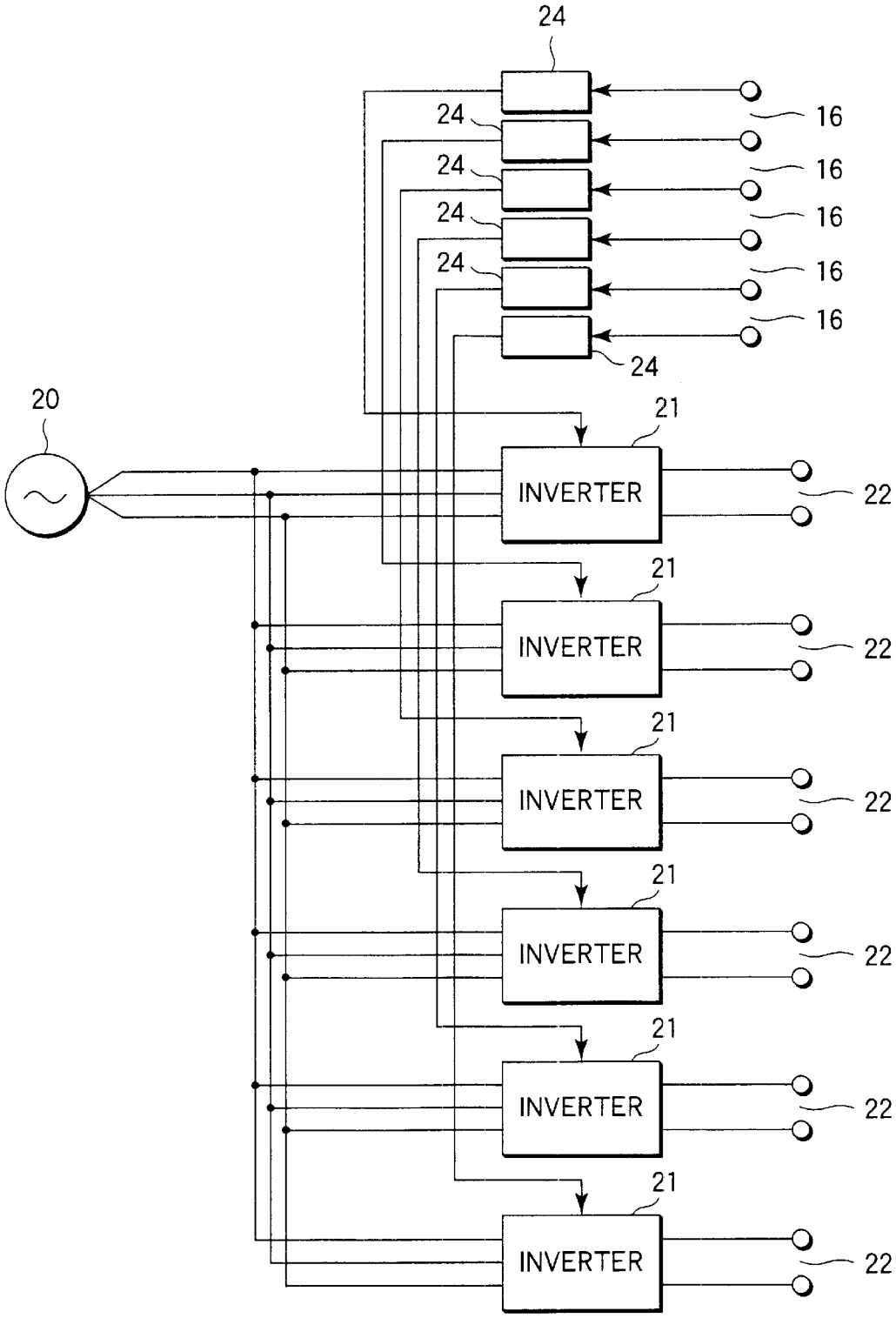
FIG. 6 is a circuit diagram for the inductive heat generation mechanism shown in FIG. 5.

The structure corresponding to such the requirement, is a third embodiment of the present invention as shown in FIG. 5. As easily be understood from FIG. 5, a plurality of temperature sensors 11 are prepared. Then, these are arranged at positions opposite to the arrangement positions of each of inductive coils 8, in the peripheral wall of the roller main body 1. Further, as shown in FIG. 6, the same number as the inductive coils 8, of the inverters 21 and the temperature adjusters 24 are prepared. Of course, the single phase voltage outputted from each of inverters 21 is in the same phase as each other.

The output voltage of each of inverters 21 is applied onto each of inductive coils 8 through the power source lead wire 9. Further, the temperature signal detected by each of temperature sensors 11 is sent to each of temperature adjusters 24. The output voltage of the inverter 21 is controlled by the output of each of temperature adjusters 24. The other structure is not specifically different from that of FIG. 3 and FIG. 4. According to this structure, in the same manner as in the structure shown in FIG. 3, the unbalance on the three-phase power source side and the load side is not generated.

Then, each temperature along the shaft center direction on the surface of the roller main body 1 is detected by each temperature sensor 11, and corresponding to its detection value, the output voltage of each of inverters 21 is adjusted. In this case, in the case where the temperature setting values set in all of temperature adjusters 24 are the same, when the temperature on the surface of the roller main body 1 is partially changed, the changed portion is detected by the temperature sensor 11, and the inverter 21 corresponding to this is controlled through the temperature adjuster 24 corresponding to the temperature sensor 11.

According to this, the surface temperature of the roller main body 1 can be restored quickly responding to its change. Further, when the temperature setting value set to each of temperature adjusters 24 is an objective temperature value in each portion of the roller main body 1, the temperature of each portion can be controlled to the same temperature as the setting value.

Figure 7:
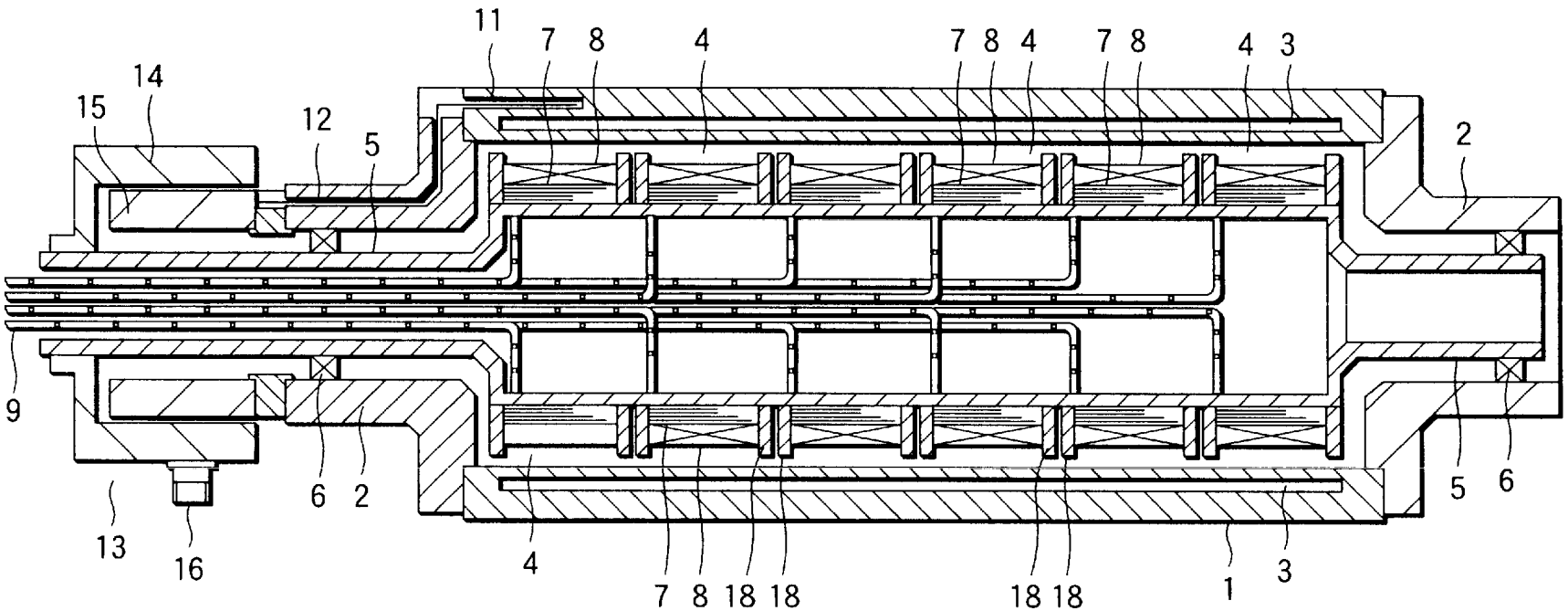
FIG. 7 is a sectional view showing yet a fourth embodiment of the present invention.

In FIG. 7, a fourth embodiment of the present invention is shown. The structure shown in FIG. 7 is a structure in which a plurality of inductive heat generation mechanisms 4 composed of iron cores 7 and inductive coils 8 are arranged along the shaft center direction of the roller main body 1. In this case, the structure is as follows: when yokes 18 are provided on both sides of each of inductive heat generation mechanisms 4, the magnetic path in each of inductive heat generation mechanisms 4 is independent of each other, and the magnetic flux passing through each of magnetic paths does not interfere with each other.

When generally, the yoke 18 is provided in this manner, even when each of inductive coils is directly excited by the three-phase power source, each magnetic path can be theoretically independent of each other, however, actually, the leakage magnetic flux is generated although it is a slight amount, and there is a case in which it passes through the other magnetic paths. Accordingly, it is very difficult to delete the unbalance on the power source side and the load side.

Further, as shown in the drawing, in the case where 3 or its multiple of inductive heat generation mechanisms are provided, when each of them is equally connected to the three-phase lines, even though the unbalance on the power source side can be reduced, when the other numbers of inductive heat generation mechanisms are provided, these can not be equally connected to the three-phase lines, and as the result, the generation of the unbalance as described above can not be avoided.

However, even in such the case, the inverter 21 whose input is the three-phase voltage as shown in FIG. 4, is prepared, and when the inductive coil 8 of each of inductive heat generation mechanisms 4 is excited by the output voltage of the inverter 21, in the same manner as in each embodiment, no unbalance on the three-phase power source side and the load side is generated.

Figure 8:
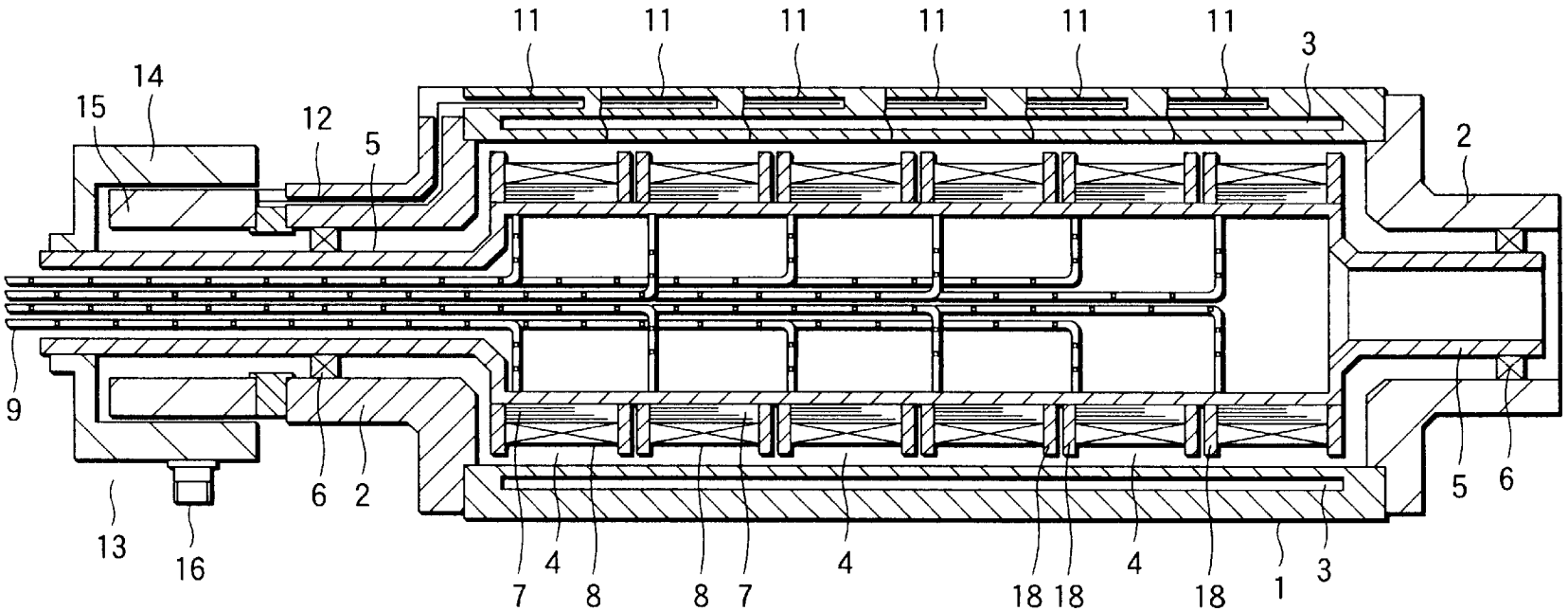
FIG. 8 is a sectional view showing still yet a fifth embodiment of the present invention.

A fifth embodiment shown in FIG. 8 corresponds to FIG. 5, and a plurality of temperature sensors 11 are arranged corresponding to each of inductive heat generation mechanisms 4. In this case, in the same manner as in the case shown in FIG. 6, a plurality of inverters 21 and temperature adjusters 24 may be prepared. According to this, the heat generation temperature of the roller main body 1 portion corresponding to each of inductive heat generation mechanisms 4 can be controlled independently of each other, in the same manner as in FIG. 5.

The inverter used for the phase conversion in the present invention, has an adjusting function which can arbitrarily set and change the frequency of its output voltage. By utilizing the function, an another advantage is obtained other than advantage that the single phase power source is obtained. That is, the principle of inductive heat generation in the inductive heating roller apparatus is that: the alternating magnetic flux crosses the roller main body, and thereby, the short circuit current in which the roller main body is one turn, is induced in the peripheral wall of the roller main body. Further, when this magnetic flux passes through the wall thickness portion of the peripheral wall of the roller main body, the eddy current is generated. By the Joule heat due to this short circuit current and the eddy current, the roller main body is heated.

Generally, in the case of the low frequency current, it is well known that its depth of penetration becomes large. Accordingly, when the frequency of the current generated in the roller main body is low, the heat generation due to the short circuit current is dominant. Reversely, in the case of the high frequency current, its depth of penetration becomes small. Accordingly, when the frequency of the current generated in the roller main body is high, the heat generation due to the eddy current is dominant over the others.

Accordingly, when the frequency of the single phase output voltage of the inverter applied onto the inductive coil as the exciting voltage is adjusted and the frequency of the alternating magnetic flux generated by the inductive coil is selected, so that the impedance matching can be obtained corresponding to the wall thickness, inner diameter, diameter of the inductive coil, and length, then, the highly efficient operation condition can be selected.

Further, when the roller main body is formed of the magnetic material, the roller main body itself performs an action as the magnetic path. Accordingly, the short circuit current and the eddy current are generated here, and the roller main body is heated. In contrast to this, when the roller main body is formed of the non-magnetic material such as stainless steel, aluminum, or copper, the roller main body itself does not perform an action as the magnetic path, and the alternating magnetic flux generated by the inductive coils pass through the external space of the inductive coils, and a part of that flux crosses the roller main body.

The short circuit current flows in the roller main body corresponding to the crossed magnetic flux as described above, and on the other hand, the magnetic flux does not pass in such a manner that the magnetic flux penetrates the wall thickness portion of the roller main body in the axial direction, but passes in such a manner that it crosses the roller main body toward the radial direction, and goes out of the external space of the roller main body, and at this time, the eddy current is generated only by the magnetic flux which crossed the roller main body.

Accordingly, in the case where the roller main body is formed of the non-magnetic material, when, by appropriately adjusting the output frequency of the inverter, the frequency of the alternating magnetic flux generated by the inductive coil is made high and the number of alternation of the magnetic flux is increased, and the eddy current is increased, then, even when the roller main body is formed of the non-magnetic material in which it is conventionally difficult to be inductively heat-generated, it can effectively be inductively heat-generated.

Incidentally, because, when the output frequency of the inverter is increased, the depth of penetration of the current is decreased, and the heat generation due to the short circuit current is decreased, when the frequency of the single phase output voltage of the inverter which is applied onto the inductive coil as the exciting voltage is adjusted, and the frequency of the alternating magnetic flux generated by the inductive coil is selected so that the increase of the eddy current and the decrease of the short circuit current are balanced and the impedance matching is obtained, then, the good efficient operation condition can be selected. Accordingly, the frequency range appropriate for its use is appropriately 10 Hz–1 kHz.

According to the present invention as described above, even when the three-phase power source is utilized as the exciting power source and it excites the inductive coil of the inductive heat generation mechanism, by using the inverter and converting the three-phase into the single phase, the unbalance is not generated on the three-phase power source side nor load side, and accordingly, the three-phase power source can be effectively utilized. Further, the following effects can also be attained: when the three-phase power source is used in this manner, even when a plurality of inductive heat generation mechanisms are provided, and the heat generation temperature of the peripheral wall of the roller is partially and arbitrarily controlled, the utilization efficiency of the three-phase power source is not lowered, and further, when the inverter whose output frequency can be freely adjusted and set, is used, by selecting its output frequency, the good efficient operation condition can be selected, and even the roller, formed of non-magnetic material in which conventionally the inductive heat generation is difficult, can be effectively inductively heat-generated.

What is claimed is:

1. An induction heating roller apparatus comprising:

a rotating roller;

an inductive heat generation unit arranged in said rotating roller;

a plurality of inductive coils arranged in the shaft center direction of said roller, being provided in said inductive heat generation unit;

an input power source being a three phase power source; and an inverter outputting a single phase voltage, wherein the single and same phase voltage outputted from said inverter is applied to said inductive coil as an exciting voltage; and wherein the rotating roller includes:

a plurality of temperature sensors provided on said rotating roller and each outputting a first signal corresponding to a portion of said roller corresponding to one of said plurality of inductive coils; and a plurality of temperature adjusters comparing the first signal from said each temperature sensor with a set temperature value of each said inductive coil and outputting a second signal corresponding to a difference based on the comparison into said inverter, wherein said inverter adjusts said single phase voltage in accordance with the second signal.

2. The induction heating roller apparatus according to claim 1, wherein an output frequency of the inverter is freely adjusted.

3. The apparatus according to claim 1, wherein the rotating roller includes a plurality of gas-liquid filled jacket chambers provided inside a peripheral wall of the roller.

4. An induction heating roller apparatus, comprising:

a rotating roller;

an inductive heat generation unit arranged in said rotating roller;

a plurality of inductive coils arranged in the shaft center direction of said roller, being provided in said inductive heat generation unit;

an input power source being a three phase power source; and a plurality of inverters, each inverter outputting a single phase voltage, wherein the single and same phase voltage outputted from each of inverters is respectively applied to each of inductive coils as an exciting voltage; and wherein the rotating roller includes:

a plurality of temperature sensors provided on said rotating roller and each outputting a first signal corresponding to a portion of said roller corresponding to one of said plurality of inductive coils; and a plurality of temperature adjusters comparing the first signal from said each temperature sensor with a set temperature value of each said inductive coil and outputting a second signal corresponding to a difference based on the comparison into said inverter, wherein said inverter adjusts said single phase voltage in accordance with the second signal.

5. The induction heating roller apparatus according to claim 4, wherein the voltage outputted from each of inverters is respectively freely adjusted independently.

6. The induction heating roller apparatus according to claim 5, wherein each output frequency of the inverters is freely adjusted.

7. The induction heating roller apparatus according to claim 4, wherein each output frequency of the inverters is freely adjusted.

8. The apparatus according to claim 4, wherein the rotating roller includes a plurality of gas-liquid filled jacket chambers provided inside a peripheral wall of the roller.

9. An induction heating roller apparatus comprising:

a rotating roller;

an inductive heat generation unit arranged in said rotating roller;

a plurality of inductive coils arranged in the shaft center direction of said roller, being provided in said inductive heat generation unit;

an input power source being a three phase power source; and an inverter outputting a single phase voltage, wherein the single and same phase voltage outputted from said inverter in applied to said inductive coil as an exciting voltage; and wherein the rotating roller includes:

temperature sensors provided on said rotating roller and each outputting a first signal corresponding to a portion of said roller corresponding to one of said plurality of inductive coils; and temperature adjusters comparing the first signal from said each temperature sensor with a set temperature value of each said inductive coil and outputting a second signal corresponding to a difference based on the comparison into said inverter, wherein said inverter adjusts said single phase voltage in accordance with the second signal.

* * * * *